US005958279A

United States Patent [19]

Kawamura et al.

[11] Patent Number: 5,958,279

[45] Date of Patent: Sep. 28, 1999

[54] REFRACTORY SLIDE-GATE PLATE

[75] Inventors: Toshio Kawamura, Takahama; Kazuhide Kawai, Hadano; Shigeki Niwa, Toyoake, all of Japan

[73] Assignee: Toshiba Ceramics Co., Ltd, Tokyo, Japan

[21] Appl. No.: 08/068,105

[22] Filed: May 28, 1993

[30] Foreign Application Priority Data

May 29, 1992 [JP] Japan ..... 4-139465

[51] Int. Cl.[6] ..... B22D 41/08

[52] U.S. Cl. ..... 222/600; 222/603

[58] Field of Search ..... 222/600, 603; 266/236

[56] References Cited

U.S. PATENT DOCUMENTS 4,179,046 12/1979 Jeschke et al. ..... 222/603
4,545,512 10/1985 Shapland et al. ..... 222/603
4,583,721 4/1986 Arakawa et al. ..... 222/603
5,004,131 4/1991 Russo ..... 222/600
5,100,034 3/1992 Russo ..... 222/600

*Primary Examiner*—Scott Kastler
*Attorney, Agent, or Firm*—Foley & Lardner

[57] ABSTRACT

A refractory slide-gate plate including a refractory base plate which is designed in a ring shape or so as to have a recess portion on a surface thereof, a refractory plate member which is fixedly engaged with the inside of the ring-shaped refractory base plate or with the recess portion of the refractory slide-gate to be integrated with the refractory base plate, and an inert gas supply groove comprising a step portion which is formed in 2 to 20 mm width and in 2 to 20 depth on at least one of the inner peripheral portion of the ring-shaped refractory base plate and the inner peripheral portion of the recess portion. The refractory plate member is preferably formed of $Al_2O_3$—$ZrO_2$—C-based refractory material or $ZrO_2$-based refractory material.

19 Claims, 3 Drawing Sheets

REFRACTORY SLIDE-GATE PLATE

BACKGROUND OF THE INVENTION

1. Field of the Invention

This invention relates to a refractory plate for a slide gate (hereinafter referred to as "slide-gate plate"), and particularly to a refractory plate which is formed of a base plate and a separate plate disposed at the center portion of the base plate in combination, and which has an inactive-gas supply groove on a slide surface thereof.

2. Description of Related Art

A slide gate device has been conventionally widely used with being connected to a ladle or a tundish which is used in a molding process for iron and steel. As shown in FIG. 1, the slide gate device includes an upper nozzle 2 mounted through a nozzle support brick 3 at the lower portion of a ladle 1, a fixed plate 4, a slide plate 5 and a lower nozzle 6 which are mounted at the lower side of the upper nozzle 2, and a nozzle hole 7 which is formed at the center of the upper nozzle 2 and the lower nozzle 6 so as to vertically penetrate through the upper and lower nozzles 2 and 6. The slide plate 5 is slidably moved by manipulating a drive member 8 which is linked to a hydraulic driving source (not shown), and through the sliding motion of the slide plate 5, the opening and closing operation of the nozzle hole 7 is controlled to carry out various control operations such as an operation of adjusting flow-amount of molten metal (not shown), an operation of ceasing flow-out of the molten metal, etc.

In the slide gate device as described above, the inside of the nozzle hole 7 is kept in a negative-pressure state when molten metal falls into or flows out of the nozzle hole 7, and thus outside air is sucked into the nozzle hole 7 through a gap between the slide surfaces of the fixed plate 4 and the slide plate 5. Therefore, this device has have a problem that the ingot steel is subjected to oxidation or nitrogen pickup. In order to solve this problem, conventionally, a slender groove is formed around the nozzle hole on the slide surface of the fixed plate or the slide plate of the device, and inert gas is supplied to the slender groove to prevent the outside air from being sucked into the slide surface between the fixed plate and the slide plate.

In a case where refractory material is used as raw material for the plate having the groove for the slide gate as described above, the refractory material is required to be fine and have high strength, and also the groove is required to be formed minutely and with high accuracy. Therefore, the slender groove is not necessarily easily formed.

That is, in order to integrally form a groove in a molding process, a mold comprising upper and lower molds one of which is formed with a projection corresponding to the groove is required. such a mold is expensive in cost, and its yield is remarkably lowered because an edge portion of the groove is liable to be chipped off in the molding process.

In place of the above method, the following method may be adopted to form a groove. That is, a combustible (plastic, paraffin or the like) having a shape corresponding to the profile of the groove is beforehand prepared. The combustion is molded at a predetermined position together with mixture, and then combusted in a sintering process to form a groove. However, this method can hardly provide a product with excellent accuracy.

Further, a groove may be formed in a working process after the sintering process. However, the working cost is high, and it is difficult to conduct the working on fine refractory material such as high alumina refractory, alumina-carbon refractory, etc. Therefore, restriction is imposed on selection of refractory material.

Still further, when high-temperature fluid such as molten metal or the like flows out, a large temperature difference occurs between the peripheral portion of the flow-out nozzle hole of the gate plate and the outer portion away from the nozzle hole, and thus some kinds of materials constituting these portions are frequently damaged by thermal shock. Therefore, refractory material which has high resistance against thermal shock, but has relatively-low fineness has been used for the gate plate device, and such material has a problem in corrosion resistance.

SUMMARY OF THE INVENTION

This invention has been implemented to solve the above problem of a slide-gate plate in which an inert gas supply groove is formed in a refractory slide surface, and has an object to provide a slide gate device having high resistance against thermal shock, which can be easily and highly accurately produced in high yield using highly fine refractory material having high resistance against corrosion.

Another object of this invention is to provide a refractory slide-gate plate having resistance against thermal shock in which a base plate constituting a slide surface on a slide plate or fixed plate of the slide gate device is partially engaged with and fixed to a separate refractory plate to enable a gas supply groove portion to be formed in the slide surface with high accuracy without increasing a metal mold cost and a working cost.

In order to attain the above objects, according to this invention, the refractory slide-gate plate having a nozzle hole through which molten metal flows in and out and an inert gas supply groove for supplying inert gas into the nozzle hole includes a refractory base plate which is designed in a ring shape or so as to have a recess portion on a surface thereof, and a refractory plate member which is fixedly engaged with the inside of the ring-shaped refractory base plate or with the recess portion of the refractory base plate to be integrated with the refractory base plate, the inert gas supply groove being formed on the inner peripheral portion of the ring-shaped refractory base plate or on the inner peripheral portion of the recess portion.

The inert gas supply groove which is formed on a slide surface between the refractory base plate and the refractory plate member, comprises a step portion formed on the inner peripheral portion of the ring-shaped refractory base plate or on the peripheral portion of the recess portion, and/or a step portion formed on the outer peripheral portion of the refractory plate member. The inert gas supply groove is preferably formed in 2 to 20 mm width and in 2 to 20 mm depth.

Further, the refractory plate member is preferably formed of $Al_2O_3$—$ZrO_2$—C—based refractory material or $ZrO_2$—based refractory material which has high resistance against corrosion.

According to the refractory slide-gate plate of this invention, the refractory base plate is designed in a ring shape or in such a shape as to have a recess portion, and the refractory plate member which is formed separately from the base plate is fixedly engaged with the inside of the ring-shaped base plate or the recess portion of the ring-shaped base plate in such a manner that the groove for inert gas supply is formed between the refractory base plate and the refractory plate member. Therefore, in order to form the inert gas supply groove around the plate member, no complicated metal mold is required and no working process for the groove is required after the molding process. Accordingly, in this invention, the manufacturing process can be extremely easily performed, and the accuracy can be also improved.

The metal molds which are used to produce the base plate and the plate member can be designed in a simple shape, and thus the molding cost can be suppressed. In addition, an integrally-molded product is hardly damaged at an edge portion of a slender groove, etc., and thus the yield for products can be improved. Further, the plate member to be engaged with the base plate at the center thereof is designed in more compact size in comparison with the conventional integrally-molded slide-gate plate, so that the temperature difference between the outer and inner peripheral portions of the plate member can be lowered to suppress the thermal shock. Accordingly, any refractory material can be selected for the slide-gate plate.

DETAILED DESCRIPTION OF THE PREFERRED EMBODIMENTS

Preferred embodiments according to this invention will be described hereunder with reference to the accompanying drawings. However, this invention is not limited to the embodiments as described below.

Figure 1:
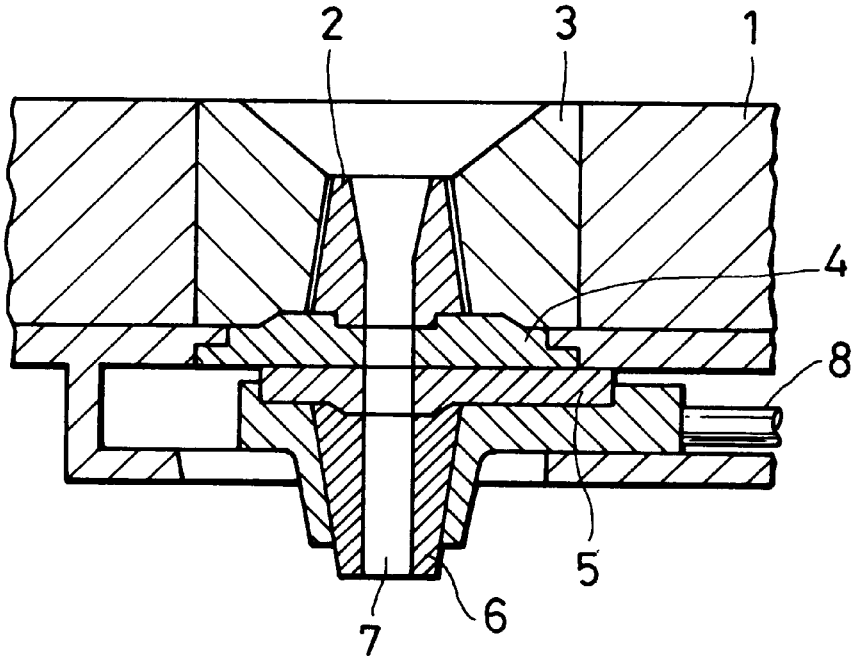
FIG. 1 is a cross-sectional view of a conventional slide gate device.
Figure 2:
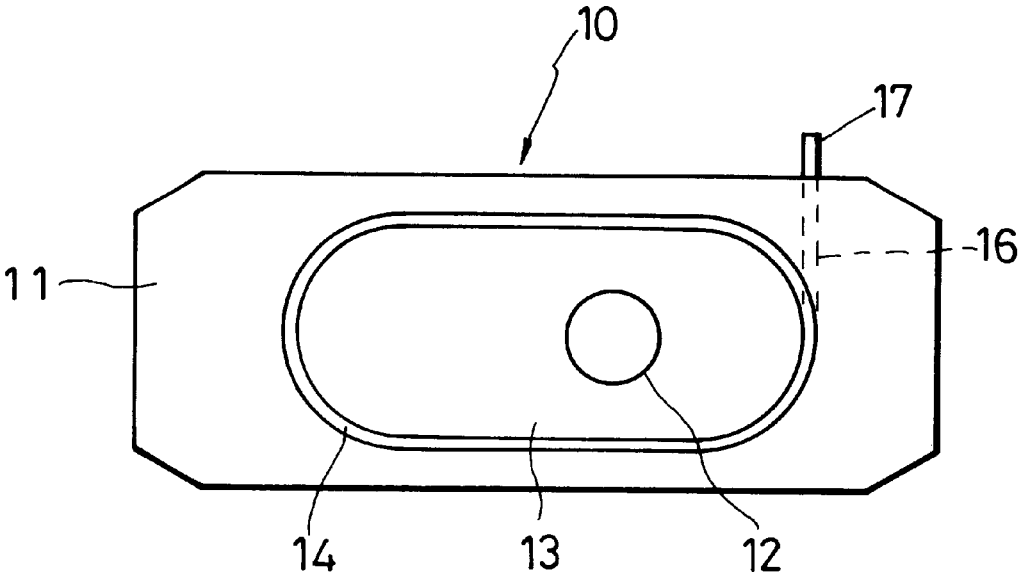
FIG. 2 is a plan view of a refractory slide-gate plate of a first embodiment according to this invention.

FIG. 2 is a plan view of a refractory slide-gate plate 10 of an embodiment of this invention.

In FIG. 2, the refractory slide-gate plate 10 comprises a combination of a refractory base plate 11 and a separate refractory plate member 13 having a nozzle hole formed therein. The refractory plate member 13 is engaged with and fixed to the refractory base plate 11 at the center portion of the slide surface of the refractory base plate 11 in such a manner that a groove portion 14 for supplying inert gas is formed around the refractory plate member 13.

In this case, any engaging manner may be adopted to engage the refractory base plate 11 with the refractory plate member 13 insofar as the refractory base plate 11 and the refractory plate member 13 forms a smooth slide surface and the inactive-gas supply groove portion 14 is formed around the refractory plate member 13.

Figure 3:
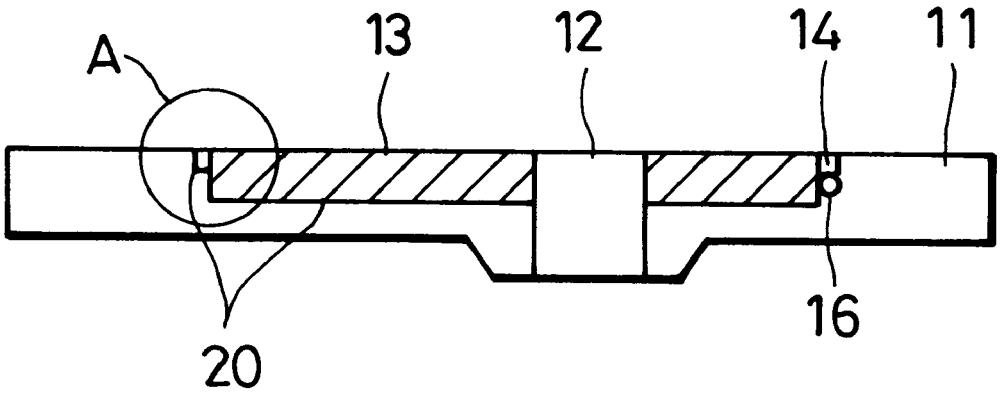
FIG. 3 is a side view showing a partial cross-section of the refractory plate of FIG. 2.

The refractory slide-gate plate as described above may be constructed as follows. As shown in FIG. 3, a recess portion 20 is formed at the center portion of the refractory base plate 11 having the nozzle hole 12, and the refractory plate member 13 having the nozzle hole 12 therein is engaged with the recess portion 20 in such a manner that a space serving as an inactive-gas supply groove 14 remains at the periphery of the refractory plate member 13 (that is, between the outer periphery of the refractory plate member 13 and the side walls of the refractory base plate 11 which define the recess portion).

Figure 4:
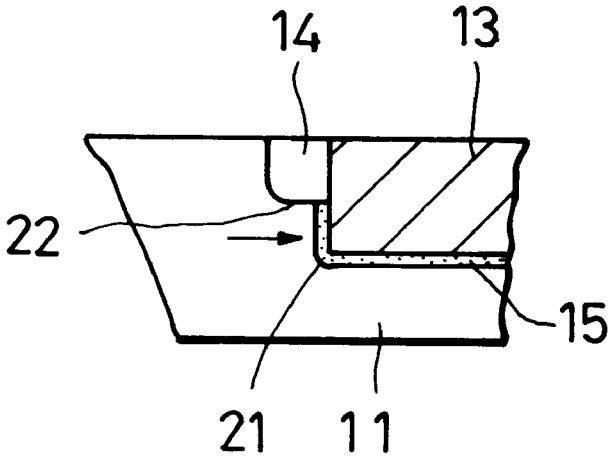
FIG. 4 is a partially enlarged view of a portion A of FIG. 3.

FIG. 4 is an enlarged view of a portion A of FIG. 3. As shown in FIG. 4, the recess portion 20 of the refractory base plate is so designed as to be a stepped recess portion having a bottom portion 21 engageable with the refractory plate member 13 and a step portion 22 constituting the groove portion 14. The stepped portion 22 forms the groove portion 14 by engaging the plate-shaped refractory member 13 with the bottom portion 21 of the recess portion of the refractory base plate 11. That is, the refractory base plate 11 and the refractory plate member 13 are engaged with each other in such a manner that the groove portion 14 is formed around the plate member 13. The bottom portion 21 of the recess portion of the refractory base plate 11 and each of the bottom portion and the bottom side portion of the refractory plate member 13 are integrally fixed to each other through a gas-impervious joint member such as refractory mortar or the like. In FIGS. 2 and 3, a reference numeral 16 represents an inert gas blowing hole. The inert gas blowing hole 16 is intercommunicated with the groove portion 14 at the one end thereof, and communicated with a gas blowing tube 17 as shown in FIG. 2 at the other end thereof.

Figure 5:
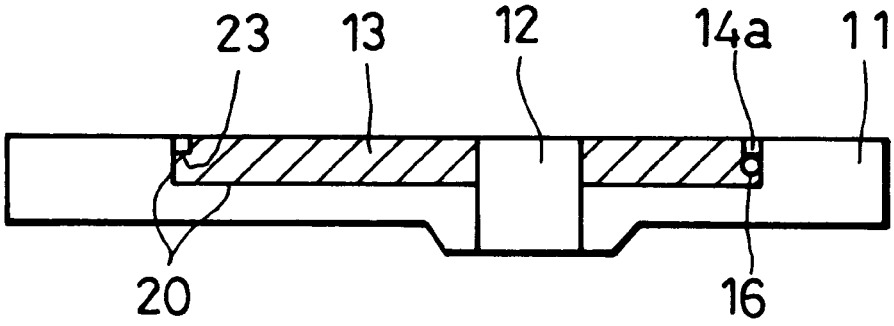
FIG. 5 is a side view showing a partial cross-section of a refractory slide-gate plate of another embodiment according to this invention.

FIG. 5 shows another manner of forming the inactive-gas supply slender groove portion 14 through the engagement between the refractory base plate 11 and the refractory plate member 13 as shown in FIG. 3. In this construction, the recess portion 20 of the refractory base plate 11 is not stepped, but a step portion 23 is formed on the peripheral portion of the surface of the refractory plate member 13. The step portion 23 thus formed is used as a groove portion 14*a* for inert gas. The base plate 11 and the refractory plate member 13 having the stepped portion 23 are engaged with and fixed to each other. The other elements of this construction are substantially identical to those of the embodiment as shown in FIGS. 2 and 3.

Figure 6:
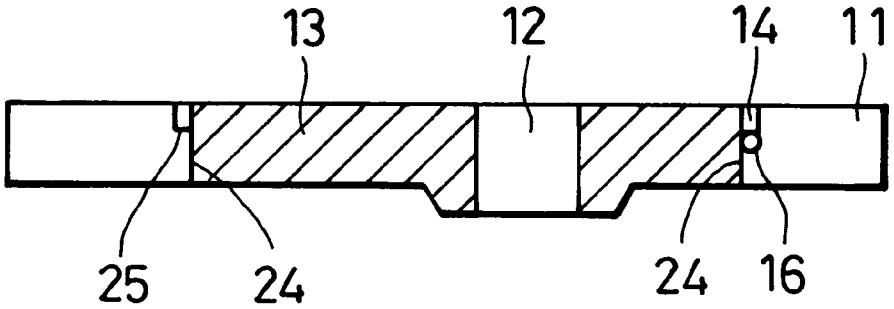
FIG. 6 is a side view showing a partial cross-section of a refractory side-gate plate of another embodiment according to this invention.

FIG. 6 shows another embodiment of the engagement between the refractory base plate 11 and the refractory plate member 13 in this case, in place of formation of the recess portion 20 on the base plate 11, the refractory base plate 11 is formed with a penetrating portion 24 to design the base plate in a ring shape. The refractory plate member 13 is engagedly inserted into the inside of the ring, and the inner peripheral surface of the ring other than a step portion 25 is fixed to the corresponding outer peripheral surface of the refractory plate member 13 through the joint member.

Figure 7:
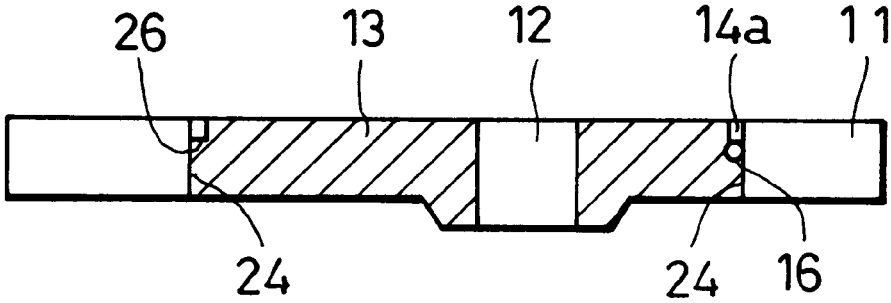
FIG. 7 is a side view showing a partial cross-section of a refractory side-gate plate of another embodiment according to this invention.

In this case, the groove portion 14 for supplying inert gas to be formed around the refractory plate member 13 is also provided by forming the step portion 25 on the upper portion of the inner peripheral portion of the refractory base plate as shown in FIG. 6. Alternately, a step portion 26 serving as a groove portion may be formed on the upper portion of the outer peripheral portion of the refractory plate member 13 as shown in FIG. 7. The refractory plate member 13 having the step portion 26 thus formed is engagedly inserted into and fixed in the inside of the ring-shaped refractory base plate 11 like the embodiment as shown in FIG. 6 in such a manner that the step portion 26 remains as the groove portion.

As described above, usually, the step portion serving as the inactive-gas supply groove may be formed on any one of the refractory base plate 11 and the refractory plate member 13 in the manner as described above. However, a step portion may be formed on both of the refractory base plate 11 and the refractory plate member 13 if occasion demands in such a manner that these step portions constitutes a groove portion in combination.

In this invention, the inactive-gas supply groove to be formed around the refractory plate member is preferably designed in 2 to 20 mm width and in 2 to 10 mm depth, and more preferably in 5 to 10 mm width and 4 to 8 mm depth. The supply amount of the inert gas to be supplied to the groove portion is usually set to 10 to 50 l/min. If the groove width is narrower than 2 mm, lubricant coated on the slide surface of the slide-gate plate would flow into the groove portion, and the groove portion is liable to be clogged.

Further, if the groove width exceeds 20 mm, the outer-diameter dimension of the plate refractory is required to be larger, and its cost is increased. That is, the widening of the inactive-gas supply groove is carried out so as to be expanded toward the outer side so that the accurate control for the flow-amount of molten metal or the like is not disturbed, and thus the outer dimension of the plate refractory is required to be larger when the groove width exceeds a predetermined value. The groove depth is preferably set to the above limited range for the same reason as the groove width.

In this invention, the recess portion 20 or the penetrating portion 21 may be formed simultaneously in the molding process of the refractory base plate, or in a working process after the sintering process. From the viewpoint of productivity, it is preferably formed simultaneously in the molding process of the refractory base plate.

Further, the size of the recess portion 20 or the penetrating portion 21 to be formed in the refractory base plate 11, that is, the arrangement shape, interval, etc. between the refractory base plate 11 and the refractory plate member 13 may be arbitrarily determined, that is, no restriction is imposed on these conditions insofar as the refractory plate member 13 surrounds the whole periphery of the nozzle hole 12 and the supply gas from the inactive-gas supply groove portion disposed around the refractory plate member 13 is allowed to homogeneously flow over the whole slide surface between the refractory base plate 11 and the refractory plate member 13 while surrounding the nozzle hole 12. Ordinarily, as shown in FIG. 2, the base plate 11 is designed in a rectangular shape whose four corners are cut out, and the recess portion 20 or the penetrating portion 21 is formed such that the refractory plate member 13 is disposed at the substantially center portion of the base plate 11. In this case, if the base plate size is 250~650×160~240 (mm), the inactive-gas supply groove portion is preferably formed at a position which is away from the end of the long axis of the base plate at 40 to 130 (mm) and away from the end of the short axis of the base plate at 20 to 60 (mm) although these values are dependent on the size of the slide gate device.

In this invention, the combination and integration of the refractory base plate and the refractory plate member may be performed as follows. That is, the refractory base plate and the refractory plate member are beforehand individually formed in advance in such a manner that these plates are engageable with each other in the arrangement as described above and a step portion serving as the groove portion for supplying inert gas remains in the integrated plate. After sintering the refractory base plate and the refractory plate member thus individually formed, both plates are engaged with each other, and fixed to each other through air-impervious joint member such as refractory mortar at the engaging portion of the plates. The nozzle holes of the refractory base plate and the refractory plate member, each hole serving as a passing hole of molten metal, may be simultaneously formed in the molding processes of the refractory base plate and the refractory plate member respectively, and may be worked for adjustment after the engagement and fixing processes of the refractory base plate and the refractory plate member. Alternately, the nozzle holes are not formed in the molding process, but they may be formed in a drill working after the sintering, engaging and fixing processes are carried out to integrate these refractories.

After the refractory base plate and the refractory plate member are integrated as described above (and the nozzle hole is formed in the drill working if occasion demands), the surface of the refractory plate member on which the inactive-gas supply groove portion is formed is further subjected to a polishing process to form a slide surface. Further, a gas introducing hole is drilled from the side or back surface of the refractory base plate to finally obtain a plate for a slide gate (slide-gate plate). The slide-gate plate thus formed is connected to a gas blow-in pipe through the gas introducing hole, and fixed with a joint member such as mortar to be installed into a slide gate device.

In the above embodiment, the groove portion for inactive-gas supply is formed on the slide plate. However, in this invention, the groove portion may be formed at the fixed plate side of the slide gate device in the same manner.

Further, the refractory material for the refractory base plate and the refractory plate member which constitutes the slide-gate plate in combination is not particularly limited to specific material, and as the refractory material may be used, for example, an oxide having high melting point such as $SiO_2$, $Al_2O_3$, MgO, $ZrO_2$ or the like, compound of mullite, spinet, zircon, etc., carbon material such as MgO—C, $Al_2O_3$ or the like, carbide such as SiC, nitride such as $Si_3N_4$, or the like. The refractory material for the refractory base plate and the refractory plate member can be selected from these refractory materials in accordance with a field to which the slide gate device is applied. In this invention, the refractory plate member which is engaged with the base plate is designed so as to be compact in size, and thus the temperature difference between the inner and outer peripheral portions of the refractory plate member is lowered. Therefore, as the refractory material for the plate member can be used fine refractory material such as $Al_2$—$O_3$—$ZrO_2$—C-based refractory, $ZrO_2$-based refractory or the like which has been conventionally unusable for the slide-gate plate because it is liable to be damaged due to thermal shock. Using these refractory materials, a slide gate plate having high resistance against corrosion can be also obtained.

As described above, according to this invention, since the refractory plate member at the center portion of the slide-gate plate is surrounded by the refractory base plate and it is designed in relatively compact size, the temperature difference between the outer and inner peripheral portions of the refractory plate member can be lowered when it is used, and the damage due to the thermal shock can be suppressed. That is, fine refractory material having improved resistance against corrosion can be selected for this portion, so that the life-time of the plate can be further lengthened. In addition, any material can be freely selected for the refractory plate member at the center portion of the slide-gate plate in accordance with its applied field (use), and thus its applicability can be more broadened to promote its industrial use.

Further, in this invention, a metal mold having complicated shape is not required to form a groove portion, and the groove portion can be formed using a metal mold having simple shape. Therefore, this invention can suppress the damage of detail portions such as the groove portion having complicated shape which has been conventionally frequently occur in the molding process, so that facilitation of the molding, improvement of the yield and cost-down can be promoted.

What is claimed:

1. A refractory slide-gate plate having a nozzle hole through which molten metal flows in and out and an inert gas supply groove for supplying inert gas into the nozzle hole, comprising:

a refractory base plate which is designed in a ring shape;

a refractory plate member which is fixedly engaged with the inside of said ring-shaped refractory base plate to be integrated with said refractory base plate, the inert gas supply groove being formed on an inner peripheral portion of said ring-shaped refractory base plate, wherein said inert gas supply groove is formed on a slide surface of said refractory slide-gate plate.

2. The refractory slide-gate plate as claimed in claim 1, wherein said inert gas supply groove comprises a step portion formed on an inner peripheral portion of said ring-shaped refractory base plate.

3. The refractory slide-gate plate as claimed in claim 1, wherein said inert gas supply groove comprises a step portion formed on an outer peripheral portion of said refractory plate member.

4. The refractory slide-gate plate as claimed in claim 1, wherein said inert gas supply groove comprises a combination of a step portion formed on an inner peripheral portion of said ring-shaped refractory base plate, and another step portion formed on an outer peripheral portion of said refractory plate member.

5. The refractory slide-gate plate as claimed in claim 1 wherein said inert gas supply groove is designed in 2 to 20 mm width and in 2 to 20 mm depth.

6. The refractory slide-gate plate as claimed in claim 1 wherein said refractory plate member is formed of $Al_2O_3$—$ZrO_2$—C-based refractory material or $ZrO_2$-based refractory material.

7. The refractory slide-gate plate as claimed in claim 2, wherein said inert gas supply groove is designed in 2 to 20 mm width and in 2 to 20 mm depth.

8. The refractory slide-gate plate as claimed in claim 3, wherein said inert gas supply groove is designed in 2 to 20 mm width and in 2 to 20 mm depth.

9. The refractory slide-gate plate as claimed in claim 4, wherein said inert gas supply groove is designed in 2 to 20 mm width and in 2 to 20 mm depth.

10. The refractory slide-gate plate as claimed in claim 2, wherein said refractory plate member is formed of $Al_2O_3$—$ZrO_2$—C-based refractory material or $ZrO_2$-based refractory material.

11. The refractory slide-gate plate as claimed in claim 3, wherein said refractory plate member is formed of $Al_2O_3$—$ZrO_2$—C-based refractory material or $ZrO_2$-based refractory material.

12. The refractory slide-gate plate as claimed in claim 4, wherein said refractory plate member is formed of $Al_2O_3$—$ZrO_2$—C-based refractory material or $ZrO_2$-based refractory material.

13. The refractory slide-gate plate as claimed in claim 5, wherein said refractory plate member is formed of $Al_2O_3$—$ZrO_2$—C-based refractory material or $ZrO_2$-based refractory material.

14. A refractory slide-gate plate having a nozzle hole through which molten metal flows in and out and an inert gas supply groove for supplying inert gas into the nozzle hole, comprising:

a refractory base plate which is designed so as to have a recess portion on a surface thereof;

a refractory plate member which is fixedly engaged with the recess portion of said refractory base plate to be integrated with said refractory base plate, the inert gas supply groove being formed on an inner peripheral portion of the recess portion, wherein said inert gas supply groove is formed on a slide surface of said refractory slide-gate plate.

15. The refractory slide-gate plate as claimed in claim 14, wherein said inert gas supply groove comprises a step portion formed on a peripheral portion of the recess portion.

16. The refractory slide-gate plate as claimed in claim 14, wherein said inert gas supply groove comprises a step portion formed on an outer peripheral portion of said refractory plate member.

17. The refractory slide-gate plate as claimed in claim 14, wherein said inert gas supply gas comprises a combination of a step portion formed on a peripheral portion of the recess portion, and another step portion formed on an outer peripheral portion of said refractory plate member.

18. The refractory slide-gate plate as claimed in claim 14, wherein said inert gas supply groove is designed in 2 to 20 mm width and in 2 to 20 mm depth.

19. The refractory slide-gate plate as claimed in claim 14, wherein said refractory plate member is formed of $Al_2O_3$—$ZrO_2$—C-based refractory material or $ZrO_2$-based refractory material.

* * * * *